US005692628A

United States Patent [19]

Montgomery et al.

[11] Patent Number: 5,692,628

[45] Date of Patent: Dec. 2, 1997

[54] PRESS-ON SCREW-OFF SELF-TAPPING CLOSURE/CONTAINER PACKAGE

[75] Inventors: Gary V. Montgomery; James F. Whitehead; Clas Nilstoft, all of Evansville, Ind.

[73] Assignee: Rexam Closure, Inc., Evansville, Ind.

[21] Appl. No.: 583,780

[22] Filed: Jan. 11, 1996

[51] Int. Cl.[6] ..... B65D 1/03

[52] U.S. Cl. ..... 215/43; 215/44; 215/318; 215/320; 220/289

[58] Field of Search ..... 215/318, 329, 215/320, 43, 44, 45, 341, 342; 220/289, 288

[56] References Cited

U.S. PATENT DOCUMENTS

| | | | |
|---|---|---|---|
| 2,039,757 | 5/1936 | Von Till . | |
| 2,117,407 | 5/1938 | Davis | 220/289 X |
| 3,223,269 | 12/1965 | Willams . | |
| 3,270,904 | 9/1966 | Foster et al. . | |
| 3,371,813 | 3/1968 | Owen et al. . | |
| 3,448,881 | 6/1969 | Zipper . | |
| 3,494,496 | 2/1970 | Livingstone | 215/320 |
| 3,606,062 | 9/1971 | Frisch et al. . | |
| 3,677,431 | 7/1972 | Westfall . | |
| 3,685,677 | 8/1972 | Westfall . | |
| 3,690,497 | 9/1972 | Lecinski, Jr. . | |
| 3,690,503 | 9/1972 | Curry | 220/289 |
| 4,000,825 | 1/1977 | Westfall . | |
| 4,190,171 | 2/1980 | Kulle et al. | 220/288 X |
| 4,231,480 | 11/1980 | Spransy | 215/329 |
| 4,251,002 | 2/1981 | Middleton et al. | 215/320 X |
| 4,307,816 | 12/1981 | Manasas | 220/288 |
| 4,308,965 | 1/1982 | Dutt . | |
| 4,340,149 | 7/1982 | Mori et al. . | |
| 4,379,512 | 4/1983 | Ohmi et al. . | |
| 4,709,825 | 12/1987 | Mumford . | |
| 4,717,034 | 1/1988 | Mumford . | |
| 4,721,219 | 1/1988 | Dullabaum et al. . | |
| 4,744,478 | 5/1988 | Hahn | 215/329 X |
| 4,863,030 | 9/1989 | Bayer et al. | 215/318 X |
| 5,259,522 | 11/1993 | Morton | 215/341 X |

FOREIGN PATENT DOCUMENTS

| | | | |
|---|---|---|---|
| 4217539 | 12/1993 | Germany | 215/252 |
| 635262 | 4/1950 | United Kingdom . | |

*Primary Examiner*—Stephen Cronin

*Attorney, Agent, or Firm*—Gifford, Krass, Groh, Sprinkle, Patmore, Anderson & Citkowski, P.C.

[57] ABSTRACT

A closure-container package is illustrated in which the closure is pressed-on to the container neck and threaded off the container neck. Either the container neck or the closure has a helical thread which engages axially extending ribs on the other of the container neck or closure to form indentations in the ribs which act as threads, teeth or a track for unthreading. A continuous or rotary seal is used between the container neck and the closure which does not require a sealing force from the threaded connection.

12 Claims, 4 Drawing Sheets

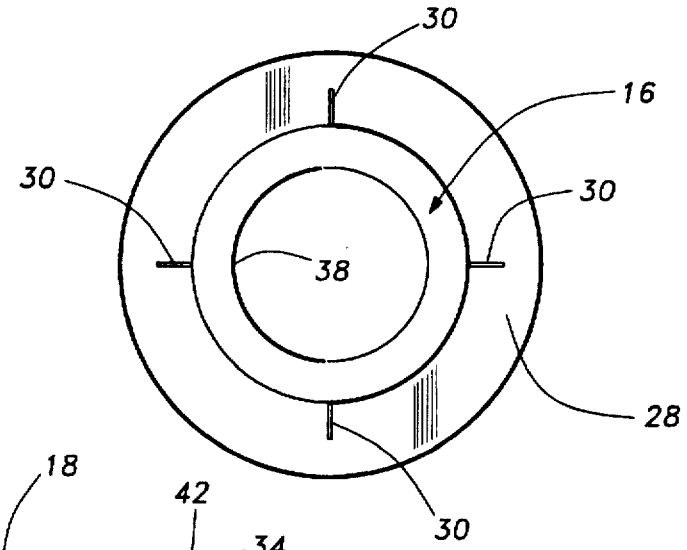
Fig-3
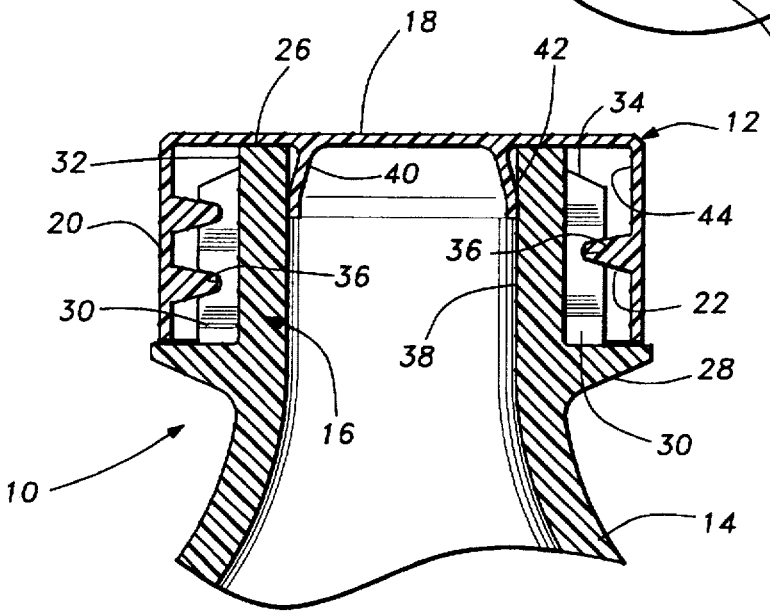
Fig-4
Fig-5
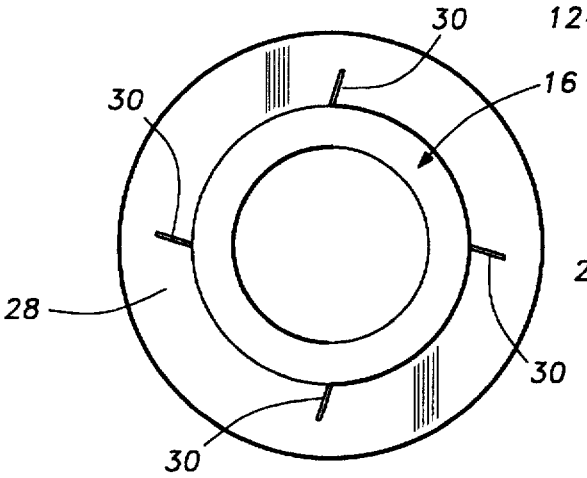
Fig-6
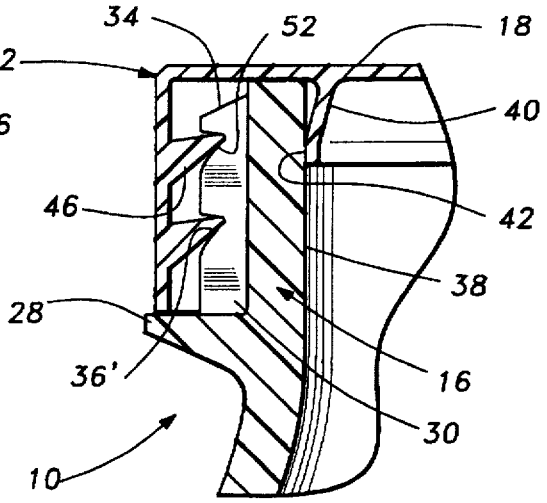

PRESS-ON SCREW-OFF SELF-TAPPING CLOSURE/CONTAINER PACKAGE

BACKGROUND OF THE INVENTION

1. Field of the Invention

This invention relates to molded thermoplastic closure/container packages, and, more particularly, this invention relates to threaded packages in which the closure can be pressed onto the container neck and threaded off the container neck.

2. State of the Art

In order to simplify the mold structure or molding procedure or to simplify the capping procedure in threaded closure/container packages there are a variety of designs in which a full thread is used on only one of the closure or container neck and something less than a full thread is used on the other of the closure and the container neck. For example, the closure or container neck is molded with partial or "jump" threads and the other is molded with partial or full threads.

In other packages, a soft deformable material is used in the closure which flows or deforms around the threads on the container neck when the closure is pushed onto the container neck. In some instances the deformable material sets up to form permanent threads. In most cases greater torque is required to remove the closure than that required when the closure is molded with full threads.

The use of circumferentially spaced ribs in the closure has been explored, in some cases requiring heating of the closure just prior to capping so that the ribs can plastically deform when the closure is pushed onto the container neck. It appears that less than satisfactory sealing is obtained even with the use of a highly resilient gasket because the seal still must rely on an axial retaining force between the full thread and the indentations.

SUMMARY OF THE INVENTION

The present invention recognizes that an unthreading track is created by a continuous or helical thread on a container neck as it contacts and leaves indentations on vertical ribs located on the closure, and that the thread can also be located on the closure and the ribs on the container neck as long as the rib and thread contact does not have to supply a sealing force.

In the present invention, the seal between the closure and container neck is independent of the means of attaching the closure to the container neck; that is, the seal does not depend upon an axial force generated by the contact between the thread and the indentation or track on the rib. The seal is created by an interference fit between a circumferential projection on one part and an axially extending cylindrical surface on the other part. Thus the integrity of the seal does not depend upon how hard the closure is pushed onto the container neck or how tightly the closure is threaded onto the container neck, and the seal is retained during initial unthreading of the closure.

The container has a cylindrical neck or is supplied with a fitment having a cylindrical neck. The closure has a top and an annular skirt depending from the periphery of the top. A plurality of generally radially projecting, axially extending and circumferentially spaced ribs are located on the external surface of the cylindrical container neck or the internal surface of the annular closure skirt, and a helical thread is located on the other of the external surface of the cylindrical container neck or the internal surface of the annular closure skirt. The thread engages the ribs as the closure is pressed or pushed on the container neck moving axially over the container neck for closing the container, and the thread forms indentations in the ribs creating a track for unthreading the closure to remove the closure from the container neck. The continuous seal between the closure and the container neck is a continuous seal between a cylindrical portion on one of the closure and the cylindrical container neck and a radial projection on the other of the closure and the container neck which extends toward and contacts the cylindrical portion.

In a preferred form of the invention, the radial projection of the continuous seal includes an inner skirt depending downwardly and outwardly from the top of the closure, and the cylindrical portion includes an inner surface of the cylindrical neck.

The ribs extend generally radially outward from the container neck or generally radially inward from the closure skirt. If the ribs are exactly radial or on a diameter of the closure or container neck, they will have a maximum structural rigidity so that a maximum force will be required to push the closure onto the container neck. In a preferred embodiment, the ribs are skewed from a purely radial or diametric line to allow the ribs to give or flex as they make contact with the thread, requiring a lower, usually more desirable, capping force. The deviation from purely radial can be up to 20°–25°, still providing enough radial force to create the indentation track necessary.

In another embodiment of the invention, a tamper indicating band can be added to the closure using cooperating ratchet stops on the band and container neck. The connecting webs or frangible connection between the closure and container neck can be weaker and easier for the consumer to break since in press-on capping the ratchets do not have to bump past each other or cam over one another as with a conventional threaded design.

In a preferred form of the ratchet teeth tamper indicating band, the ratchet teeth on one of the tamper indicating band and the container neck can be formed in a thin wall flange as indentations made by the ratchet teeth on the other of the tamper indicating band and container neck.

DRAWING

The advantages of the present invention will be more apparent from the following detailed description when considered in connection with the accompanying drawing wherein:

FIG. 3 is a plan view of the top of the container neck taken along line 3—3 of FIG. 2;

FIG. 4 is an elevational view in cross section showing the closure cap applied to the container neck;

FIG. 5 is a plan view of the top of a container neck similar to FIG. 3 of another embodiment of the container neck;

FIG. 6 is a partial elevational view in cross section showing another embodiment of the invention;

DESCRIPTION OF THE PREFERRED EMBODIMENTS

Figure 1:
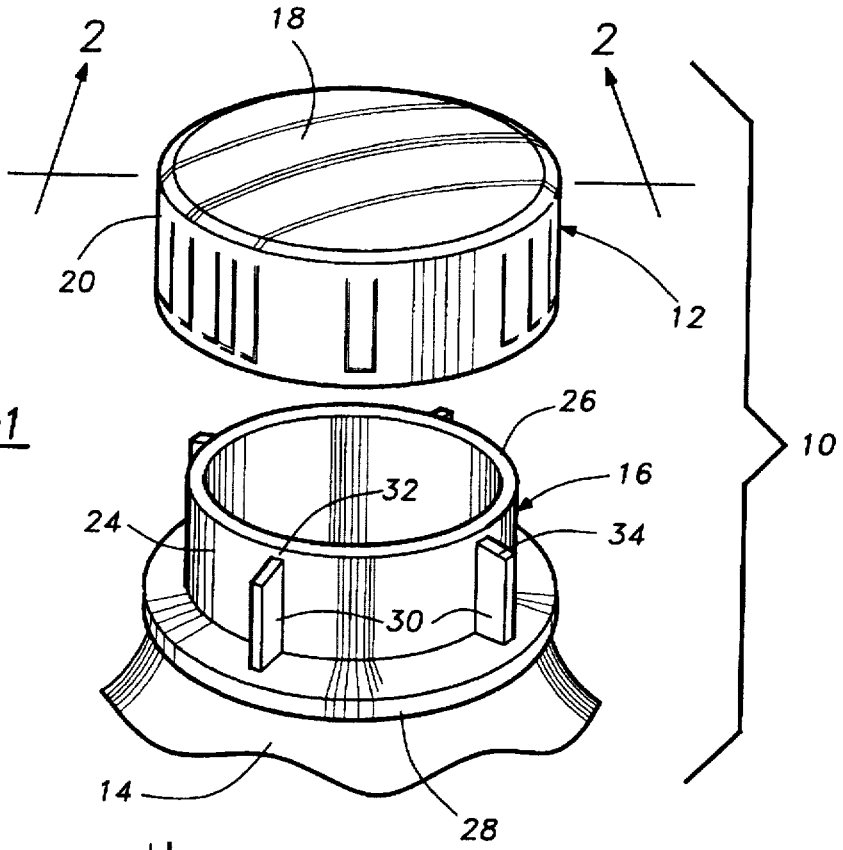
FIG. 1 is an exploded perspective view of a closure cap and container neck employing the invention.
Figure 2:
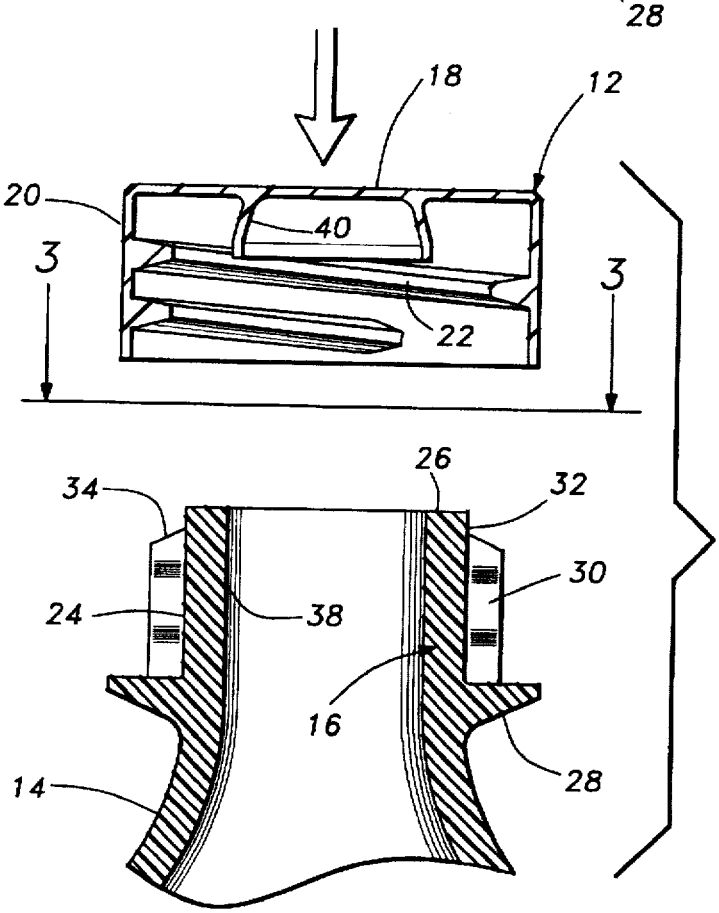
FIG. 2 is an elevational view in cross section taken along lines 2—2 of FIG. 1.

Referring to FIGS. 1–4, the closure-container package 10 of this invention includes a closure 12 and a container 14 having a cylindrical neck 16. The closure 12 is a simple threaded cap with a flat top 18 and an annular skirt 20 having an internal helical thread 22. In a conventional threaded package, the container neck would have a complementary helical thread for engagement with the cap thread 22. In the illustrated press-on closure-container 10 of the invention, the container neck has four circumferentially equally spaced ribs 30 projecting radially outward from the external surface 24 of the container neck 16 and extending axially downward from a point below the container neck lip 26 to the container neck flange 28. Leaving a cylindrical surface or space 32 above the top 34 of the ribs 30 on the neck to facilitate guiding and centering the cap before the resistance of the neck ribs against the cap threads is encountered. The top 34 of the ribs can be slopped downwardly to facilitate the thread 22 passing over the ribs. The container neck flange 28 is commonly supplied for handling and appearance but is not necessary to the practice of the invention.

When the closure cap has been pressed onto the container neck 16 as seen in FIG. 4, the thread will form indentations 36 in the ribs acting as a track when unthreading torque is applied to the closure. The ribs flex going on and the plastic creep allows the thread to become more deeply imbedded and permanent over time, forming an interlock between the closure and the container neck. While the cap will normally be pressed in place in the initial capping, it can be applied by a rotary threading motion with a downward force. The cap can be reapplied by threading back on the track left by the threads or it can be pressed on again creating a new track. The cap will bottom out by contact of the container lip 26 with the inside of the cap top 18 or by contact of the bottom of the cap skirt 20 with the container neck flange 28, but neither of these contacts are relied upon to form a seal.

It will be appreciated that the rib thickness, material properties and radial interference of the ribs will all determine the press-on force and the efficiency in forming the thread interlock. Also the shape or the angle of the top and bottom surfaces of the thread affect these factors as explained with relationship to FIG. 6.

A plug or inner skirt 40 having a frusto-conical shape diverges outwardly and downwardly from the cap top 18 to constitute a projection 42 as it contacts the cylindrical inner surface 38 of the container neck 16 to provide a continuous seal between the closure 12 and the container neck 16 as best seen in FIG. 4. The seal is independent of the thread interlock created between the helical cap thread 22 and the indentations or tracks 36 on the ribs 30 of the container neck.

As best in seen in FIGS. 1 and 3, the ribs 30 are radial or on a diametric line of the container neck 16 which provides a relatively stiff column resistance as the rib meets the cap thread 22 in pressing the cap onto the container neck. To provide more give or yielding, the ribs 30 can be skewed from the radial as shown in FIG. 5. Further rib flexibility can also be provided by stopping the ribs short of the flange 28 or eliminating this container neck flange.

In the embodiment of FIG. 6 it is shown that the cap thread 46 can be ideally designed so that the closure presses on easily over the container neck ribs 30 by making the crest of the thread pointed and giving it an upward angle. The thread can thus yield as its bevel undersurface 52 passes over the beveled top surface 34 of the container neck ribs 30. The pointed thread 46 makes a barb-like indentation 36' making it hard to pull the cap off.

Figure 7:
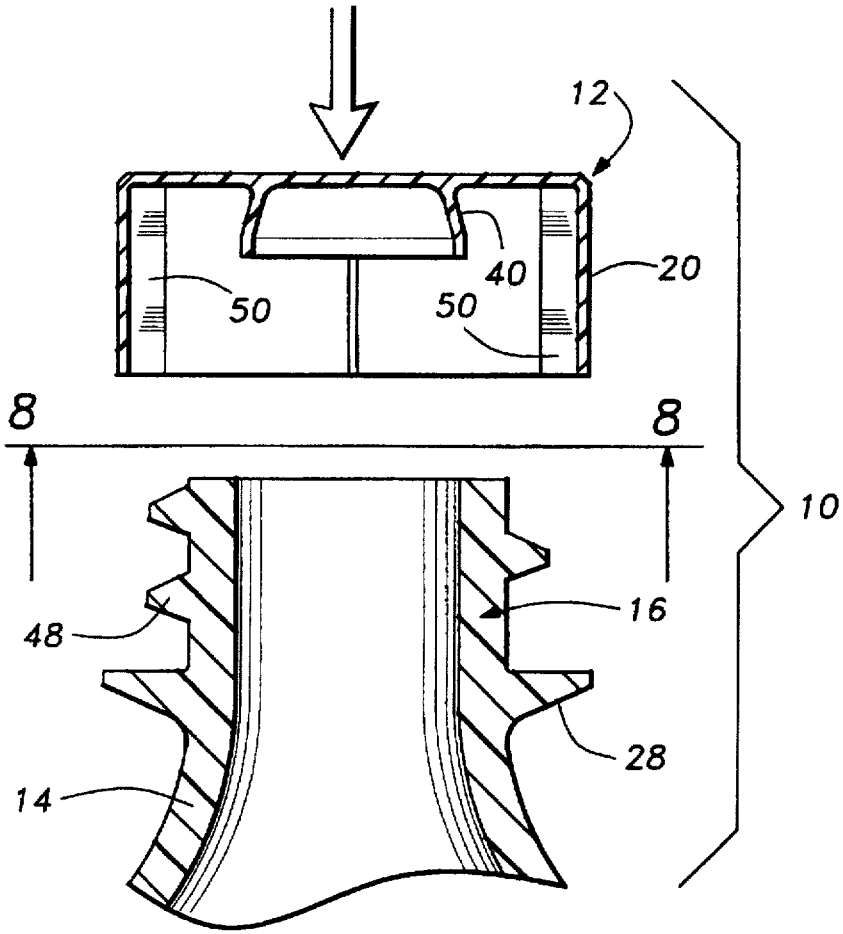
FIG. 7 is an exploded perspective view similar to FIG. 1 showing another embodiment of the invention.
Figure 8:
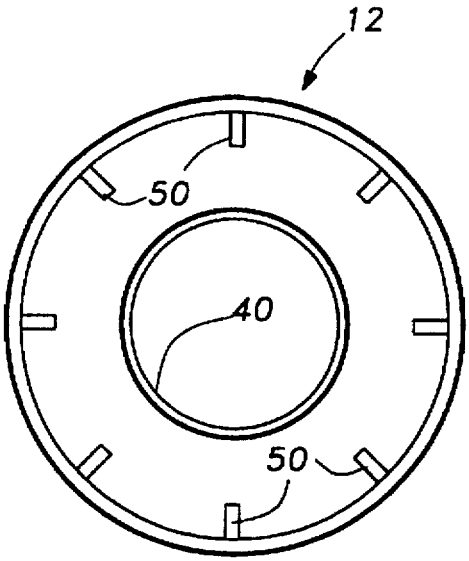
FIG. 8 is a bottom plan view of the closure cap taken along lines 8—8 of FIG. 7.

In the embodiment of FIGS. 7 and 8, the helical thread 48 is an external thread on the container neck 16, and the ribs 50 project inwardly from the cap skirt 20 providing the same type of press-on, thread-off structure as the embodiments of FIGS. 1–4.

Figure 9:
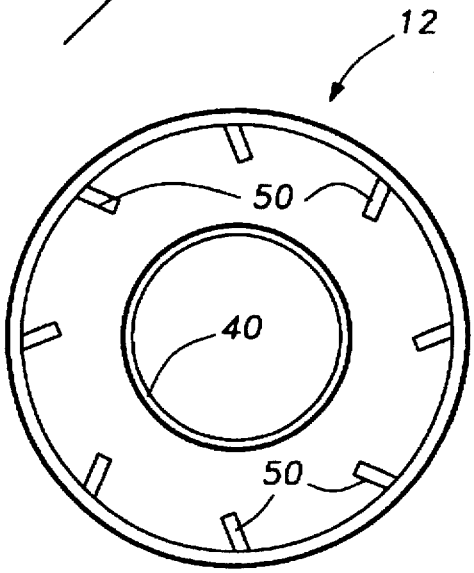
FIG. 9 is a bottom plan view of a closure cap similar to FIG. 8 showing another embodiment of the invention.

FIG. 8 shows the use of eight ribs 50 on the cap skirt 20. Any suitable number of ribs can be used, preferably more than one and equally spaced around the cap circumference for centering and uniformity. FIG. 9 shows that the ribs 50 skewed from the radial position on the closure 12 in the same manner as the ribs 30 were skewed on the container neck as shown in FIG. 5.

Figure 10:
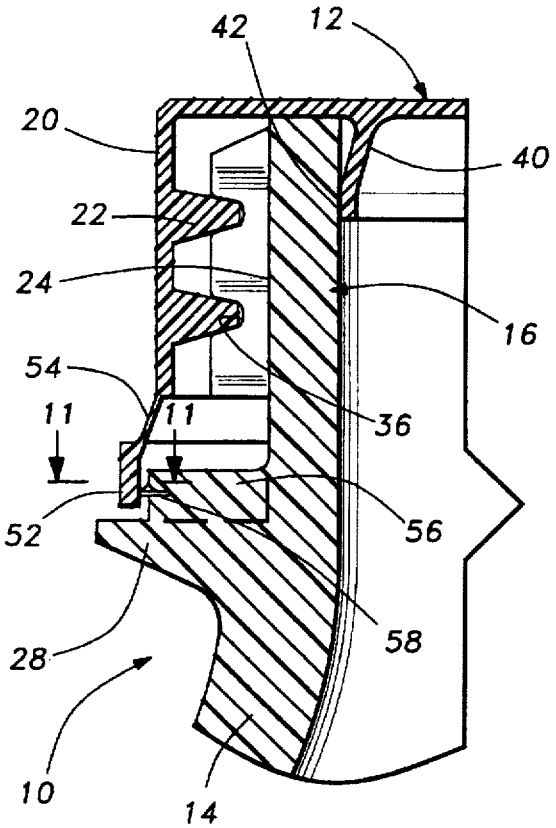
FIG. 10 is a partial elevational view in cross section similar to FIG. 4 showing the addition of a tamper indicating band feature to the closure cap and container neck.
Figure 11:
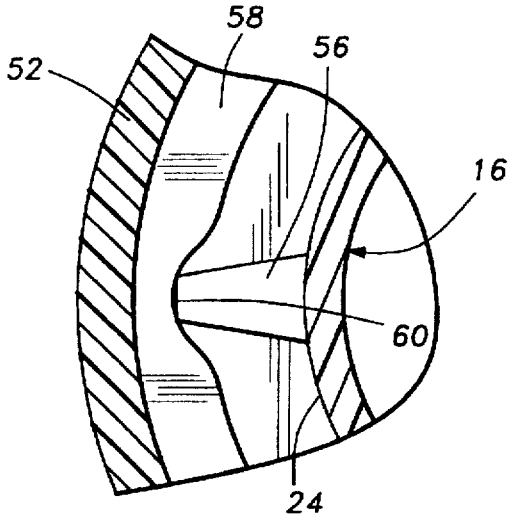
FIG. 11 is a sectional plan view taken along lines 11—11 of FIG. 10.

FIGS. 10 and 11 illustrate that a tamper indicating feature can be added to the closure-container package 10 of this invention. A tamper indicating band 52 depends from the bottom of annular closure skirt 20 by a frangible connection in the form of circumferentially spaced frangible webs 54. A plurality of circumferentially spaced ratchet teeth on the band are designed to engage a plurality of circumferentially spaced ratchet teeth on the container neck in a manner similar to a conventionally threaded closure-container package as illustrated in U.S. Pat. No. 5,040,092. When the closure 12 is unthreaded from the container neck 16, the band ratchet teeth engage the container neck ratchet teeth to stop relative rotation between the band and the container neck causing fracture of the frangible webs 54. Since ratchet teeth are used and the closure is initially pushed onto the container neck, the frangible webs 54 can be made thinner to be sheared more easily when the cap is unthreaded, when contrasted to the thicker frangible webs that are necessary when the cap is initially threaded onto the container neck requiring the ratchet teeth to bump over each other during the tightening process.

In the specific embodiment illustrated in FIGS. 10 and 11, circumferentially spaced ratchet teeth 56 extend outwardly from the external neck surface 24 to contact a thin wall flange 58 extending inwardly from the tamper indicating band 52 to create indentations 60 which serve as ratchet teeth on the tamper indicating band 52. In a similar manner, ratchet teeth extending inwardly from the tamper indicating band can contact a thin wall flange extending outwardly from the container neck to form indentations or ratchet teeth on the container neck.

Figure 12:
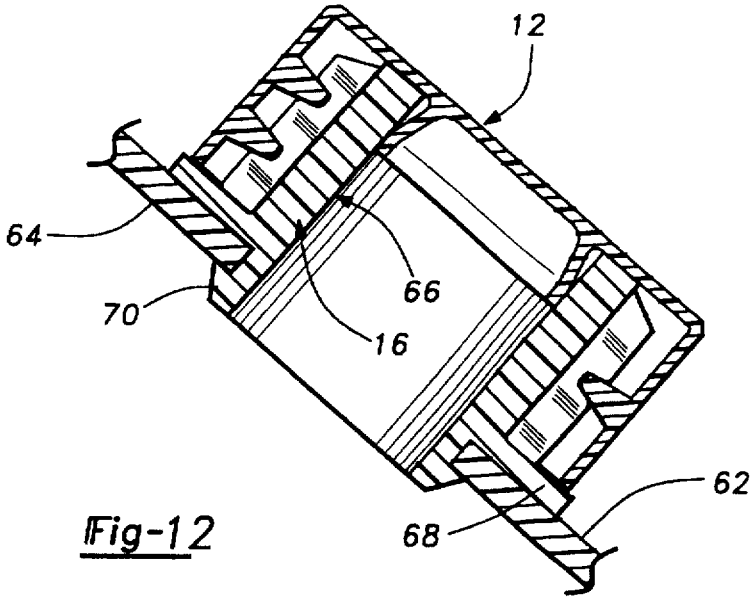
FIG. 12 is a sectional elevational view of another embodiment of the invention.

In the embodiment illustrated in FIG. 12, the container 62 is in the form of a juice or milk carton having a gabled top 64, and the fitment 66 supplies the container neck 16. The fitment flange 68 can be bonded to the container top 64, or the fitment can have a snap-on flange 70 which engages the container top 64. Other suitable fitments can be used for metal can tops and the like to supply the cylindrical container neck which coacts with the closure to form the self-threading closure-container of the invention.

We claim:

1. A plastic closure-container package comprising, in combination:

a molded plastic container having a cylindrical neck;

a molded plastic closure having a top, an outer annular skirt depending from the periphery of said top and an inner annular skirt concentric with and spaced radially inwardly from said outer annular skirt;

a plurality of radially projecting, axially extending and circumferentially spaced ribs on one of an external surface of said cylindrical container neck and an internal surface of said outer annular closure skin, and a helical thread on the other of said external surface of the cylindrical container neck and said internal surface of the outer annular closure skin;

said ribs and thread engaging each other when said closure is moved axially over said container neck for closing said container, engagement of said thread with said ribs forming indentations in said ribs creating a track for unthreading said closure for removal of said closure from said container neck; and a continuous seal between said closure and container neck not requiring axial force created by said thread and rib engagement, said seal spaced apart from a lip of said cylindrical container neck, said seal including:

a cylindrical portion on one of the inner annular skirt of said closure and an inner surface of said cylindrical container neck;

a continuous radial projection on the other of the inner annular skirt of said closure and said inner surface of said cylindrical container neck extending toward and contacting said cylindrical portion to form said continuous seal.

2. The closure-container package according to claim 1 wherein said ribs are located on the external surface of said container neck, and said thread is located on the internal surface of said outer annular closure skirt.

3. The closure-container package according to claim 2 wherein said ribs are skewed from diametrical lines to said container neck.

4. The closure-container package according to claim 1 wherein said ribs are located on an internal surface of said outer annular closure skirt, and said thread is located on the external surface of said container neck.

5. The closure-container package according to claim 4 wherein said ribs are skewed from diametrical lines to said closure skirt.

6. The closure-container package according to claim 1 wherein the crest of said thread is pointed having an upward angle.

7. The closure-container package according to claim 1 wherein the radial projection of said continuous seal includes said inner skirt depending downwardly and outwardly from the top of said closure, and said cylindrical portion includes an inner surface of said cylindrical neck.

8. The closure-container package according to claim 1 further including a tamper indicating band depending from said outer closure skirt by a frangible connection, and a plurality of circumferentially spaced ratchet teeth on said band which engage a plurality of circumferentially spaced ratchet teeth on said container neck; wherein as said closure is unthreaded from said container neck, the band ratchet teeth engage the container neck ratchet teeth to stop relative rotation between the band and container neck causing fracture of said frangible connection.

9. The closure-container package according to claim 8 wherein the ratchet teeth on one of said tamper indicating band and said container neck are formed in a thin wall flange as indentations made by the ratchet teeth on the other of said tamper indicating band and said container neck.

10. The closure-container package according to claim 9 wherein the ratchet teeth on the container neck extend outwardly from an external surface of said container neck to contact said thin wall flange extending inwardly from said tamper indicating band creating indentations in said flange which act as the ratchet teeth on said tamper indicating band.

11. The closure-container package according to claim 1 wherein said container neck is integrally molded with said container.

12. The closure-container package according to claim 1 wherein said container neck is molded as a fitment and said fitment is attached to said container.

* * * * *